US009526327B1

(12) United States Patent
Lin

(10) Patent No.: US 9,526,327 B1
(45) **Date of Patent: *Dec. 27, 2016**

(54) FURNITURE HINGE AND FOLDING MECHANISM

(71) Applicant: Zhuhai Shichang Metals Ltd., Zhuhai (TW)

(72) Inventor: Wen-Sheng Lin, Kaohsiung (TW)

(73) Assignee: Zhuhai Shichang Metals Inc. (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/255,561

(22) Filed: Sep. 2, 2016

Related U.S. Application Data

(63) Continuation-in-part of application No. 15/166,697, filed on May 27, 2016, now Pat. No. 9,462,880, which is a continuation-in-part of application No. 14/800,935, filed on Jul. 16, 2015, now Pat. No. 9,380,862.

(51) Int. Cl.

| | |
|---|---|
| ***A47B 3/083*** | (2006.01) |
| ***A47B 3/08*** | (2006.01) |
| ***A47B 3/087*** | (2006.01) |
| ***A47C 11/00*** | (2006.01) |
| ***A47C 4/04*** | (2006.01) |

(52) U.S. Cl.
CPC ..... *A47B 3/0818* (2013.01); *A47B 3/087* (2013.01); *A47C 4/045* (2013.01); *A47C 11/00* (2013.01)

(58) Field of Classification Search
CPC ..... A47B 3/087
USPC ..... 108/129, 130, 131, 132, 115, 162, 167,108/168, 169, 171, 172, 173, 174; 292/171
See application file for complete search history.

(56) References Cited

U.S. PATENT DOCUMENTS

| | | | |
|---|---|---|---|
| 833,024 | A | 10/1906 | Clark et al. |
| 1,552,690 | A | 9/1925 | Frantz |
| 1,958,980 | A | 5/1934 | Vaughan |
| 2,046,790 | A | 7/1936 | Phillips |
| 2,772,935 | A | 12/1956 | Read |
| 2,871,076 | A | 1/1959 | Mell |
| 3,096,732 | A | 7/1963 | Wilkinson |
| 4,026,221 | A | 5/1977 | Wilson et al. |
| 4,605,250 | A | 8/1986 | Simo-Company |
| 6,394,005 | B1 | 5/2002 | Isensee et al. |
| 7,278,361 | B2 | 10/2007 | Zhurong et al. |
| 7,461,601 | B2 | 12/2008 | Jin et al. |
| 8,413,594 | B2 | 4/2013 | Ensley |
| 8,555,789 | B2 | 10/2013 | Jin et al. |
| 2002/0092445 | A1 | 7/2002 | Glover et al. |
| 2007/0272128 | A1 | 11/2007 | Lin |
| 2008/0178778 | A1 | 7/2008 | Koning et al. |
| 2011/0203493 | A1 | 8/2011 | Ashby et al. |
| 2013/0025509 | A1 | 1/2013 | Jin et al. |
| 2014/0116301 | A1 | 5/2014 | Tsai |

FOREIGN PATENT DOCUMENTS

| | | | |
|---|---|---|---|
| EP | 2255694 | A | 12/2010 |

*Primary Examiner* — Matthew Ing
(74) *Attorney, Agent, or Firm* — Luedeka Neely Group, P.C.

(57) ABSTRACT

A foldable table or bench has first and second support surface halves. A furniture leg is mounted to each half and collapses independently of the other and is movable between an extended position and a stowed position. First and second hinge assemblies each include two hinge members mounted to the support surface halves and pivotally connected to one another by hinge pins. A center rod is connected to the first and the second hinge assemblies and extends across the width of the table top halves substantially parallel to the first and second hinge pins.

12 Claims, 15 Drawing Sheets

FURNITURE HINGE AND FOLDING MECHANISM

CROSS-REFERENCE TO RELATED APPLICATIONS

This application is a continuation-in-part of application Ser. No. 15/166,697, entitled "Furniture Hinge and Folding Mechanism", filed May 27, 2016, which in turn is a continuation-in-part of application Ser. No. 14/800,935, entitled "Table Hinge and Folding Mechanism", filed Jul. 16, 2015. The contents of the '697 and '935 applications are incorporated herein by reference.

FIELD

The present invention relates to a hinge for a foldable table or bench, and more particularly to a hinge for a center-folding table or bench having a latch that is operated automatically by rotating a leg of the foldable table or bench.

BACKGROUND AND SUMMARY

A conventional table is available for providing a support effect, thereby facilitating the user using the table. However, the conventional table has a fixed structure and cannot be folded when not in use, thereby increasing space of storage, and thereby causing inconvenience in storage, package and transportation.

An objective of the present invention is to provide a foldable article of furniture (such as a table or bench) that is supported rigidly and stably when being expanded and is folded when not in use, thereby enhancing the versatility of foldable table or bench. Another objective of the present invention is to provide a foldable table or bench having a hinge.

A further objective of the present invention is to provide a foldable article of furniture (such as a table or bench) that is folded when not in use, thereby saving space of storage, package and transportation.

Another objective of the present invention is to provide a foldable table having a hinged connection between adjacent table top surfaces that includes a latch that may be placed into a stowed or a use position and wherein the latch is operated automatically by rotating one of the table legs.

Still another objective of the present invention is to provide a foldable bench having a hinged connection between adjacent bench seating surfaces that includes a latch that may be placed into a stowed or a use position and wherein the latch is operated automatically by rotating one of the bench legs.

In accordance with one embodiment of the present invention, there is provided a collapsible table having a first tabletop half and a second tabletop half. The first and second tabletop halves each have a substantially planar top surface, a bottom surface opposite the top surface, an inner edge, and an opposing outer edge which is substantially parallel to the inner edge. There are first support tubes disposed along a first edge of each of the first and second table top halves, which are mounted to the bottom surface thereof. Also, second support tubes spaced apart from the first support tubes are disposed along a second edge of each of the first and second table top halves and mounted to the bottom surface thereof.

The table also includes a collapsible leg assembly having a crossbar pivotally mounted between the first and second support tubes of each of the first and second table top halves.

Each leg assembly is operable to collapse independently of the other leg assembly and is movable between an extended position and a stowed position.

The table also includes a locking hinge assembly for pivotally connecting together the first and second table top halves and for automatically disengaging a locking feature of the hinge assembly when at least one of the collapsible leg assemblies is moved from the extended position to the stowed position. In particular, the hinge assembly includes a first hinge member and a second hinge member. Each is mounted to one of the first support tubes. The second hinge member has a pawl pin slot configured to receive a pawl pin. Additionally, a third hinge member and a fourth hinge member are each mounted to one of the second support tubes. A hinge pin or rod pivotally connects the first and second hinge members together and pivotally connects the third and fourth hinge members together.

A pawl pin is positioned in the pawl pin slot and slides in the slot between a first position and a second position. The pawl pin engages a notch of the first hinge member in the first position and prevents rotation of the first hinge member with respect to the second hinge member. The pawl pin disengages the notch of the first hinge member in the second position and allows rotation of the first hinge member with respect to the second hinge member. A spring member having spring arms engages the pawl pin and biases it toward the first position.

The locking hinge assembly includes a cable having a first end and a second end. The first end of the cable is configured to be fixedly mounted to a portion of the at least one collapsible leg assembly and the second end of the cable is configured to be fixedly mounted to the pawl pin. Pivoting the at least one collapsible leg assembly from an extended position to a stowed position causes the pawl pin to be automatically moved from the first position to the second position. Thereby disengaging the pawl pin from the notch of the first hinge member and allowing rotation of the first hinge member with respect to the second hinge member.

In accordance with another embodiment of the present invention, there is provided a collapsible article of furniture, such as a foldable table or bench. The article of furniture includes a furniture support surface including a first support surface half and a second support surface half, the first and second support surface halves each having a substantially planar top surface, a bottom surface opposite the top surface, an inner edge, and an opposing outer edge which is substantially parallel to the inner edge. For instance, the article of furniture may include first and second table top surfaces or first and second bench seating surfaces.

The article of furniture also includes a collapsible leg assembly attached to the bottom surface of each of the support surface halves. Each leg assembly is operable to collapse independently of the other leg assembly and is movable between an extended position and a stowed position. Moreover, each leg assembly has a crossbar mounted between side frame members. The crossbar rotates as the respective leg assembly is pivoted from the extended position to the stowed position.

The article of furniture also includes a first and a second support member. Each of the support members has a first end and a second end, and the first end of each support member is pivotably mounted to one of the collapsible leg assemblies.

The article of furniture also includes a locking hinge assembly, which pivotally connects together the first and second support surface halves and automatically disengages a locking feature of the hinge assembly when at least one of the collapsible leg assemblies is moved from the extended position to the stowed position. This hinge assembly includes a first hinge member having a notch for selectively engaging a pawl pin, and a second hinge member which is pivotally connected to the first hinge member. The second hinge member includes a slot configured to receive the pawl pin.

The hinge assembly also includes a hinge rod that rotationally connects the first and second hinge members together and extends across the width of the support surface halves.

The hinge assembly pawl pin has opposite ends and a side surface. The pawl pin is disposed in the slot of the second hinge member and operable to slide in the slot between a first position and a second position. The pawl pin engages the notch of the first hinge member when in the first position, thereby preventing rotation of the first hinge member with respect to the second hinge member. The pawl pin disengages the notch of the first hinge member when in the second position, thereby allowing rotation of the first hinge member with respect to the second hinge member.

The article of furniture also includes a cable having a first end and a second end. The first end of the cable is secured to a portion of the at least one collapsible leg assembly. The second end of the cable is secured to the pawl pin, such that moving the at least one collapsible leg assembly from an extended position to a stowed position causes movement of the second end of the cable, thereby moving the pawl pin from the first position to the second position to disengage the pawl pin from the notch.

In addition, the article of furniture includes a third furniture leg assembly. This third leg assembly is mounted to, and extends down from, the hinge rod.

In accordance with yet another embodiment of the present invention, there is provided a foldable article of furniture, such as a table or bench. The article of furniture generally includes a first and a second support surface half, each support surface half generally having a first side frame member mounted to the support surface half and disposed along a first edge thereof and a second side frame member mounted to the support surface half and disposed along a second edge thereof.

The foldable article of furniture also includes a first furniture leg having a crossbar rotatably mounted between the first and second side frame members of the first support surface half and a second furniture leg having a crossbar rotatably mounted between the first and second side frame members of the second support surface half. Each of the crossbars rotates as the respective furniture leg is pivoted from an extended position to a stowed position.

The foldable article of furniture also includes first and second hinge assemblies. The first hinge assembly includes a first hinge member which is mounted to the first support surface half and a second hinge member which is mounted to the second support surface half and pivotally connected to the first hinge member by a first hinge pin for pivotally connecting together the support surface halves. Likewise, the second hinge assembly includes a third hinge member which is mounted to the first support surface half and a fourth hinge member which is mounted to the second support surface half and pivotally connected to the third hinge member by a second hinge pin for pivotally connecting together the support surface halves.

A center rod is also included in the foldable article of furniture. This center rod is connected to the first and the second hinge assemblies and extends across the width of the table top halves substantially parallel to the first and second hinge pins. In some embodiments, the center rod is connected to the first hinge member. Moreover, in certain embodiments, the center rod preferably extends across the width of the table top halves in a location above the first and second hinge pins.

In certain embodiments of the foldable article of furniture, the first hinge member preferably includes a notch for selectively engaging a pawl pin and the second hinge member includes a slot configured to receive a pawl pin. A pawl pin is disposed in the slot of the second hinge member and operable to slide in the slot between a first position and a second position. In the first position, the pawl pin engages the notch of the first hinge member, thereby preventing rotation of the first hinge member with respect to the second hinge member. In the second position, the pawl pin disengages the notch of the first hinge member, thereby allowing rotation of the first hinge member with respect to the second hinge member.

Further, in certain embodiments, the foldable article of furniture also preferably includes a cable having a first end and a second end. The first end of the cable is secured to a portion of the furniture leg and the second end of the cable is secured to the pawl pin. Moving the furniture leg from an extended position to a stowed position causes movement of the second end of the cable, thereby moving the pawl pin from the first position to the second position to disengage the pawl pin from the notch. In some instance, the foldable article of furniture also preferably includes a spring member having spring arms that engage the pawl pin and urge the pawl pin toward the first position.

Further benefits and advantages of the present invention will become apparent after a careful reading of the detailed description with appropriate reference to the accompanying drawings.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

In a first aspect, the following disclosure relates to a center-folding table having a locking center hinge and collapsible legs or support members. The center-folding table may be placed in an extended or use position and also in a stowed position. In the use position, the locking hinge located between two tabletop halves ensures that the table is not inadvertently collapsed. The present invention allows this locking hinge to be disengaged automatically by simply rotating one of the support stands from the extended position to the stowed position. The locking hinge may be engaged by rotating the support stand from the stowed position to the extended position.

Figure 1:
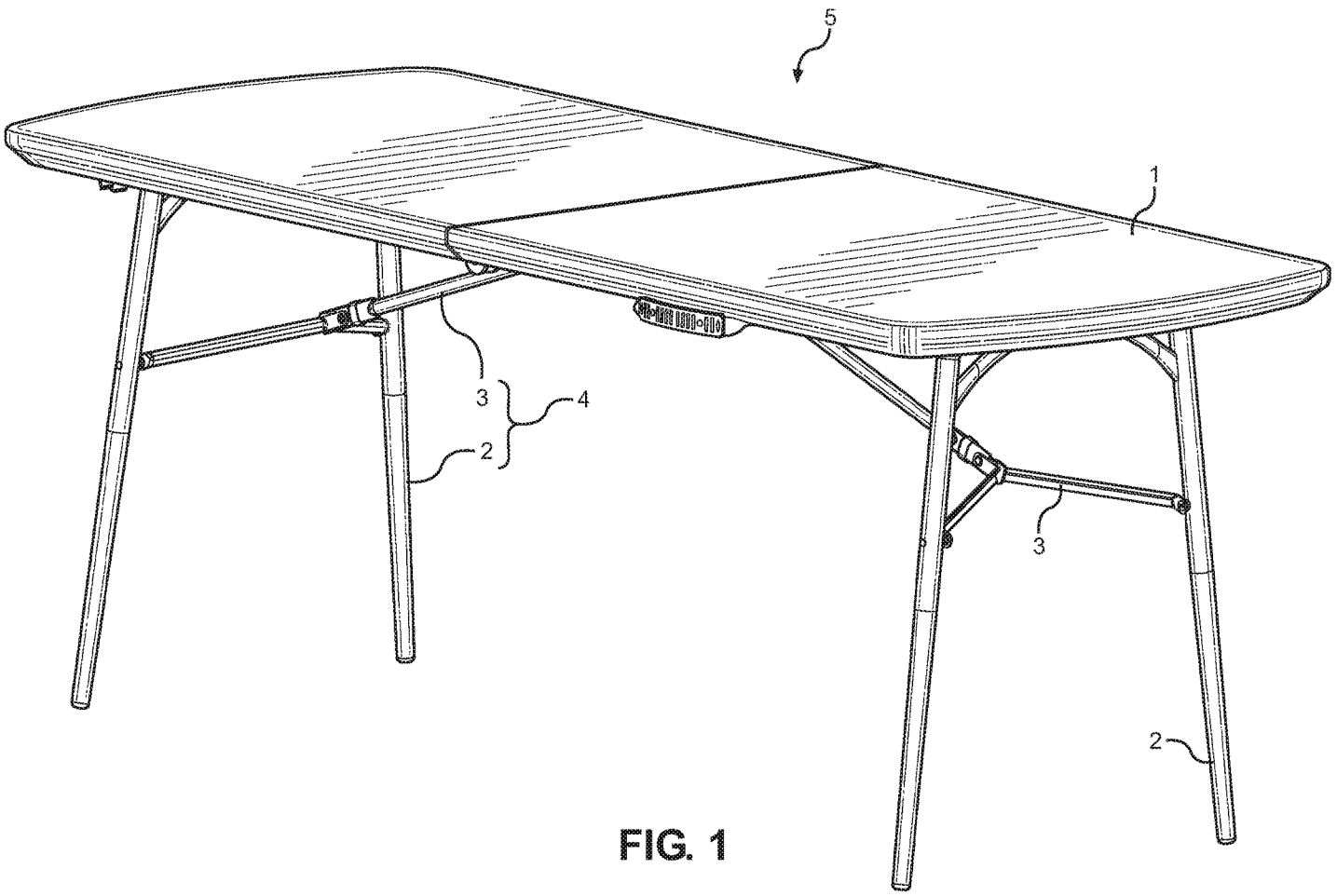
FIG. 1 is a perspective view of a foldable table with collapsible legs and a hinge assembly according to an embodiment of the present invention.
Figure 2:
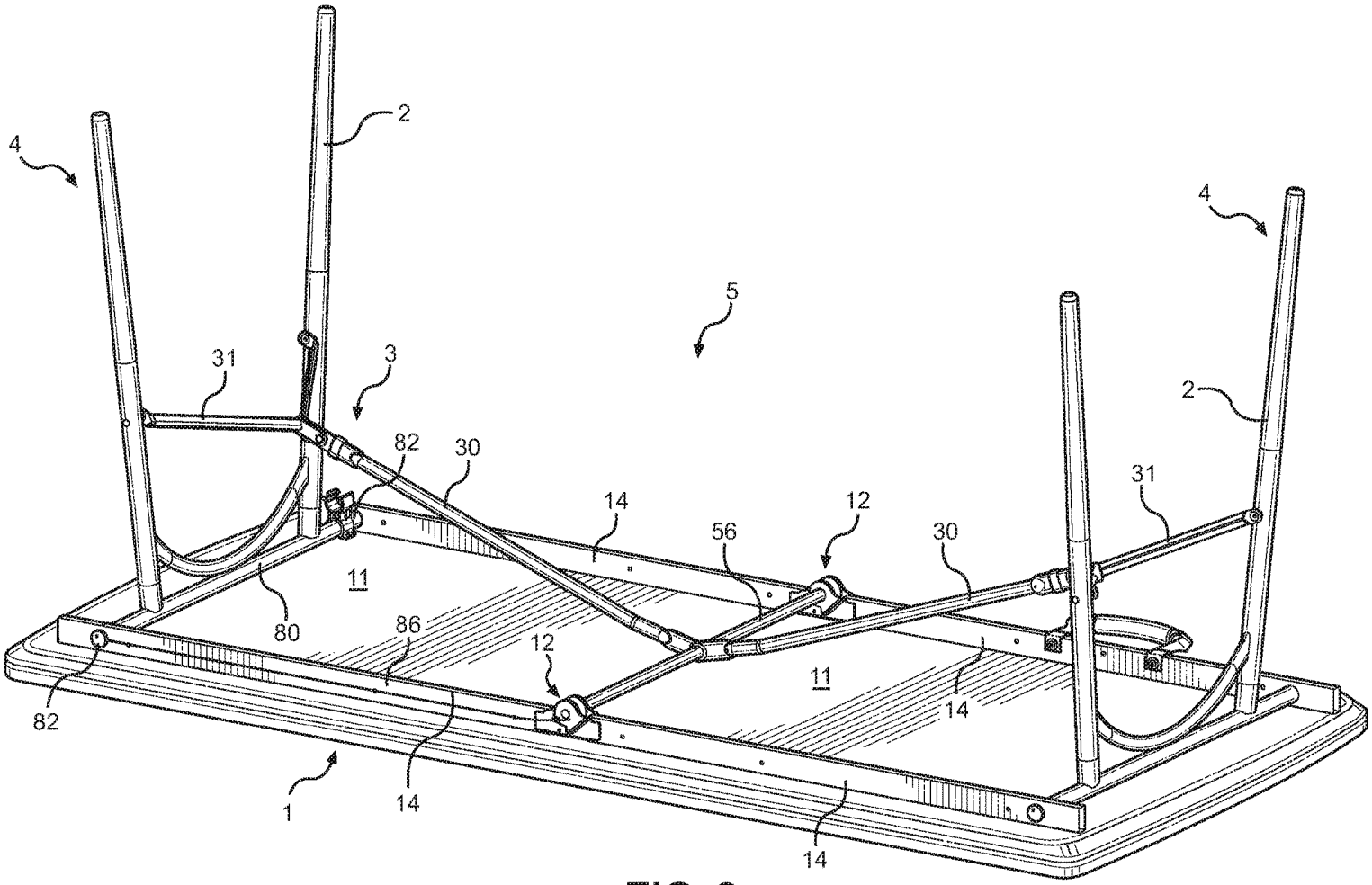
FIG. 2 is a perspective view of a bottom surface of the table depicted in FIG. 1 with support units shown in an extended position.

Referring to the drawings, there is provided in FIGS. 1 and 2 a center-folding table 5 in accordance with one embodiment of the present invention. The table 5 comprises two table boards 1 pivotally connected with each other. Each of the two table boards 1 has a bottom formed with a receiving space 11. The receiving space 11 of each of the two table boards 1 has two sides each provided with a support tube 14 secured on each of the two table boards 1 by a plurality of screws.

Figure 5:
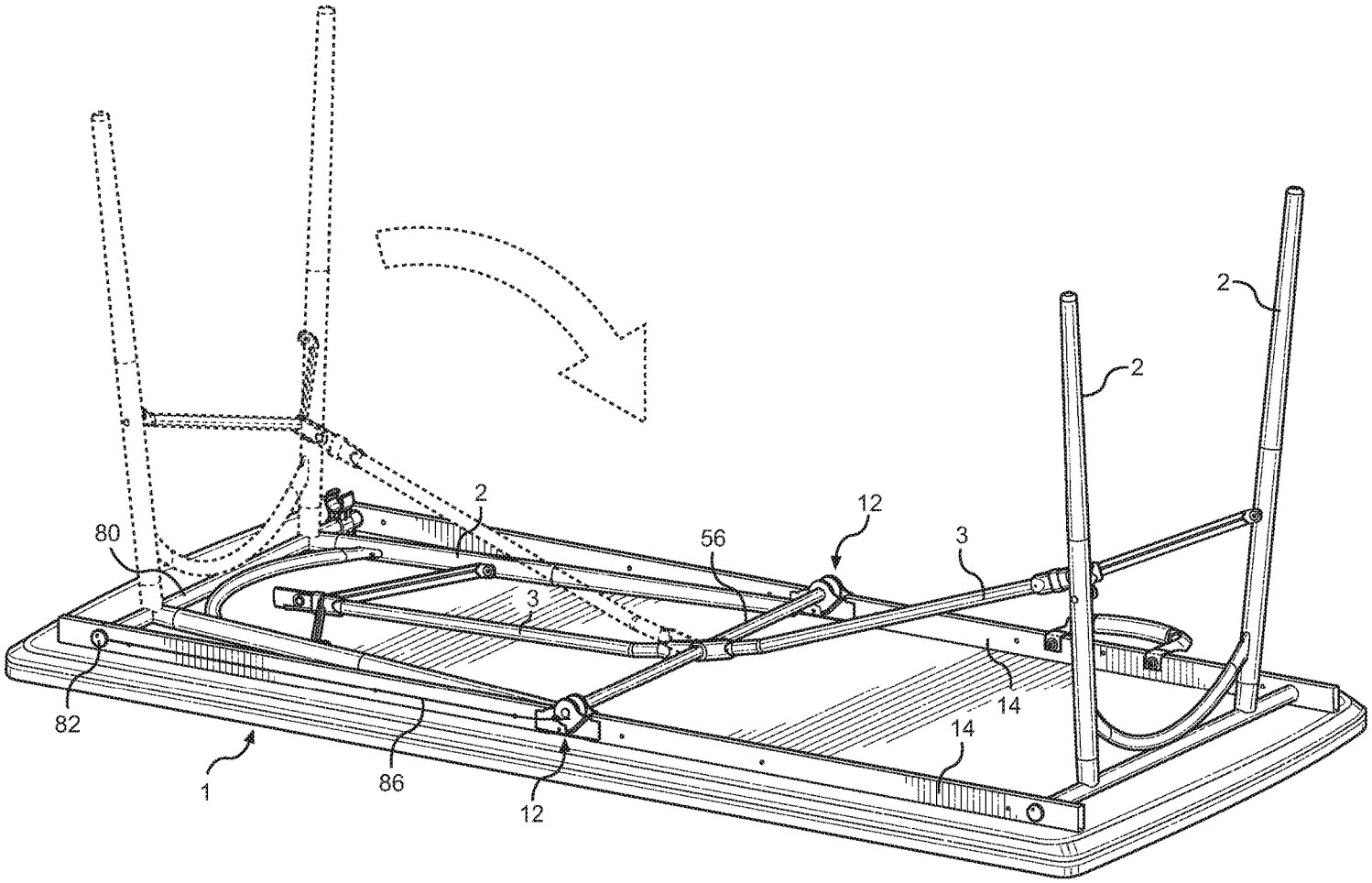
FIG. 5 is a perspective view of the foldable depicted in FIG. 1 with one support unit shown in a stowed position.
Figure 8:
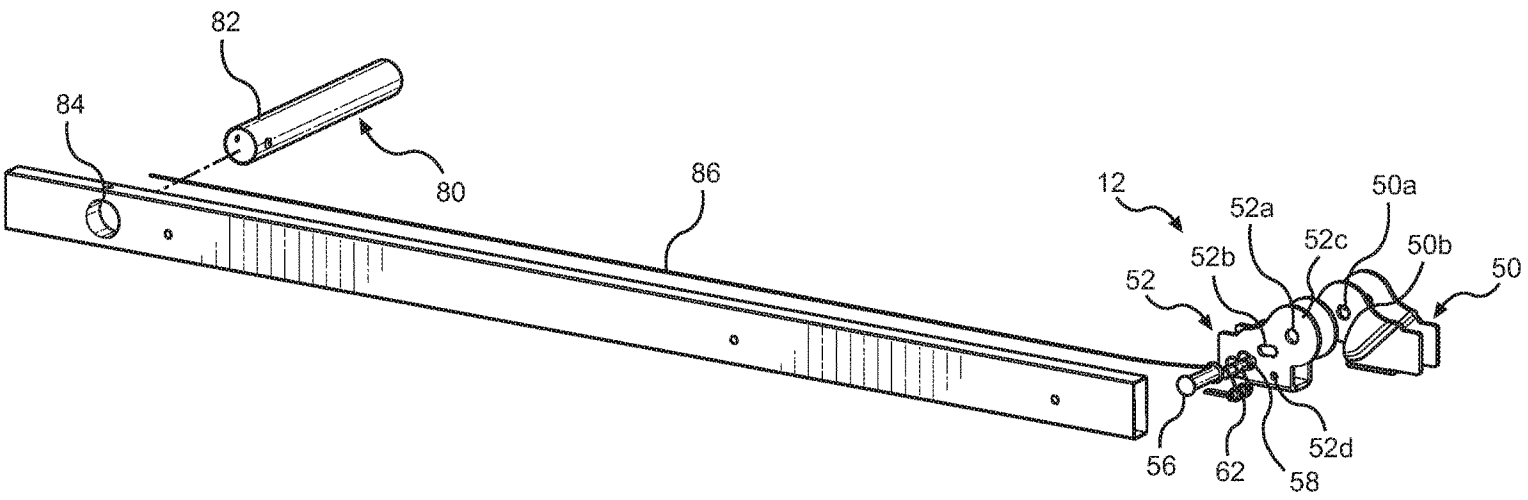
FIG. 8 is an exploded view depicting the hinge assembly shown in FIG. 2.

The table 5 also includes two support units 4, which are each foldably mounted on a respective one of the two table boards 1. Each of the support units 4 includes a support stand 2 that is mounted in the receiving space 11 of a respective one of the two table boards 1. As shown in FIGS. 2, 5 and 8, each support stand 2 has a crossbar member 80 that spans the width of the table 5 and has opposing ends 82 that extend through openings 84 in the support tubes 14. The openings 84 are sized and configured to permit the crossbar 80 to rotate within the opening.

Each support unit 4 also includes a support member 3, which includes a substantially straight support bar 30 mounted to a substantially V-shaped extension bar 31. The opposite end of the extension bar 31 is pivotally mounted at a mediate portion of the support stand 2. The opposite end of the support bar 30 is pivotally mounted to a portion of a hinge assembly 12 connecting the two table boards 1, as discussed below. The support units 4 are configured to rotate from an extended position, shown in FIG. 2, to a stowed position, shown in FIG. 5.

Figure 9:
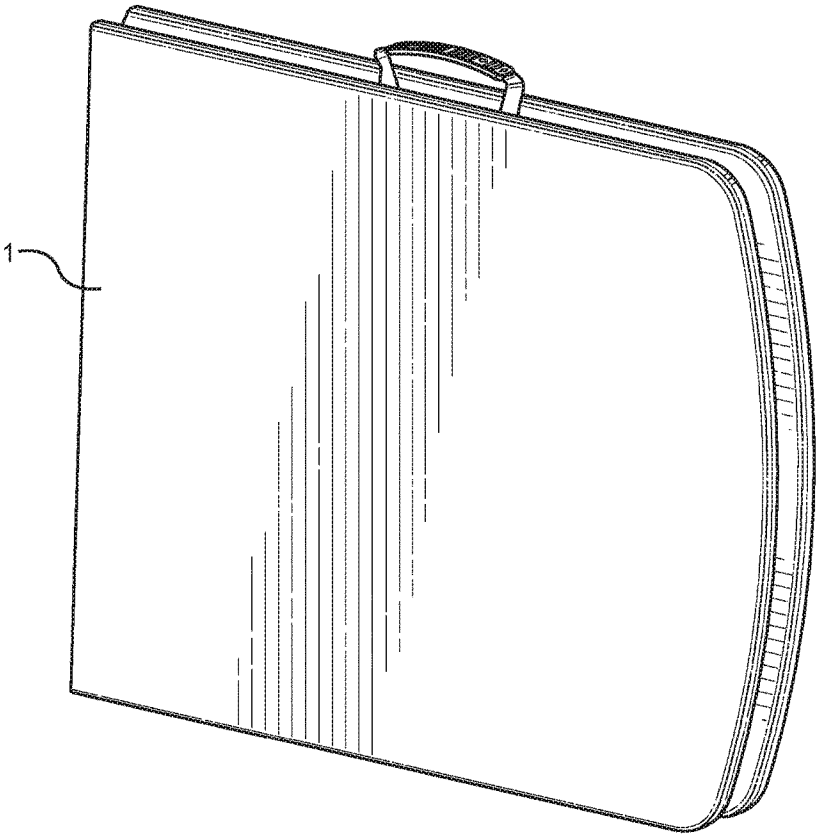
FIG. 9 is a perspective view of the foldable table depicted in FIG. 1 in a closed position.

The two table boards 1 are pivotally connected with each other by two pivot members 12, which are also referred to herein as hinge assemblies 12, and are configured to rotate from an extended position, shown in FIG. 1, to a stowed position, shown in FIG. 9. As shown in FIGS. 2, 5 and 8, each of the hinge assemblies 12 includes two hinge members 50 and 52 pivotally connected together by a hinge pin 56 which passes through apertures 50*a* and 52*a* in circular tabs 50*c* and 52*c* of the hinge members 50 and 52. A single pin 56 spans the width of the table, along the intersection of the two table boards 1, and an end of the pin connects together each of the hinge assemblies 12. The support bar 30 mentioned above is pivotally mounted to the pin 56.

On either side of the hinge member 52 are slots 52*b* through which passes a pawl pin 58. The pawl pin 58 also passes through slots 52*b* on either side of the hinge member 52. The pawl pin 58 is operable to slide laterally in the slots 52*b* between a first position and a second position. As shown best in FIG. 4, in the first position, the pawl pin 58 engages notches 50*b* in the tabs 50*c* of the hinge member 50, thereby preventing rotation of the hinge member 50 with respect to the hinge member 52. In the second position, shown in FIG. 7, the pawl pin 58 disengages the notches 50*b*, thereby allowing rotation of the hinge member 50 with respect to the hinge member 52.

A spring 62 is connected to the hinge member 52 by way of a spring pin 60. The spring pin 60 passes through apertures 52*d* in the hinge member 52 (FIG. 8) and through a coil 62*c* formed in the spring 62. The spring 62 has spring arms 62*a* extending from the coil 62*c* that engage the pawl pin 58. Due to tension in the coil 62*c*, the spring arms 62*a* constantly press against the pawl pin 58, thereby urging the pawl pin 58 toward the first position in the slots 52*b*.

The table 5 also includes a cable 86, which is disposed along the length of one of the table boards 1 parallel with the respective support tube 14 and connects the pawl pin 58 to the crossbar 80. The cable 86 enables the pawl pin to be moved from the first position to the second position automatically (and vice versa) when the support stand 2 is rotated.

Figure 3:
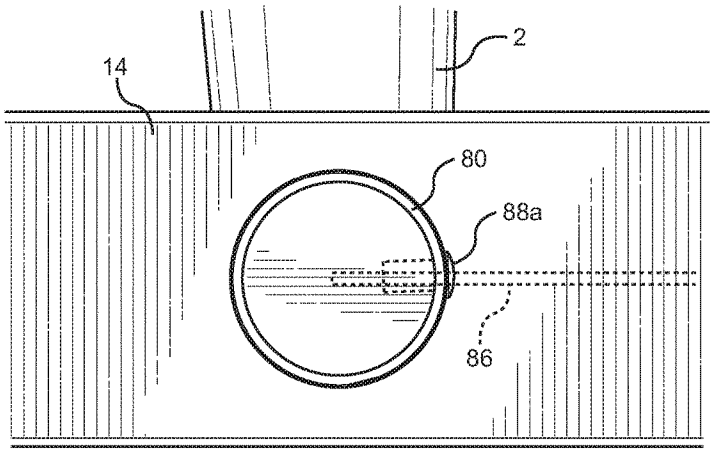
FIG. 3 is an enlarged side view of a first end of the hinge assembly depicted in FIG. 2.
Figure 4:
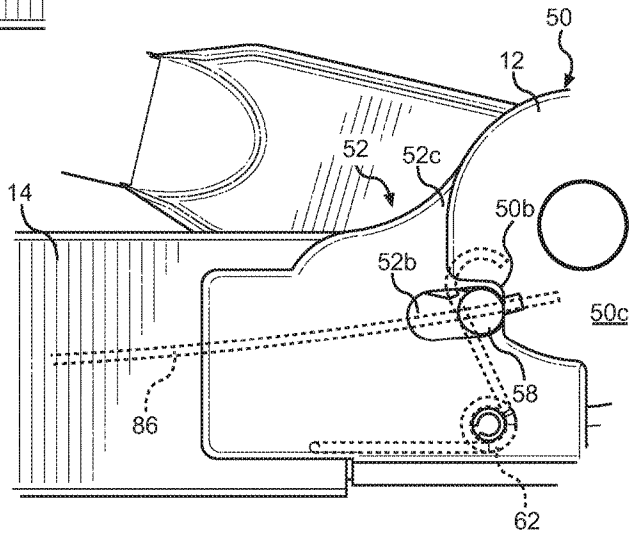
FIG. 4 is an enlarged side view of a second end of the hinge assembly depicted in FIG. 2.
Figure 6:
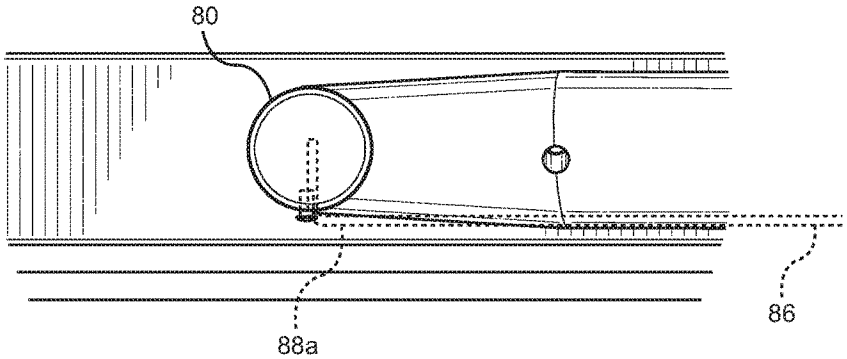
FIG. 6 is an enlarged side view of a first end of the hinge assembly depicted in FIG. 5.
Figure 7:
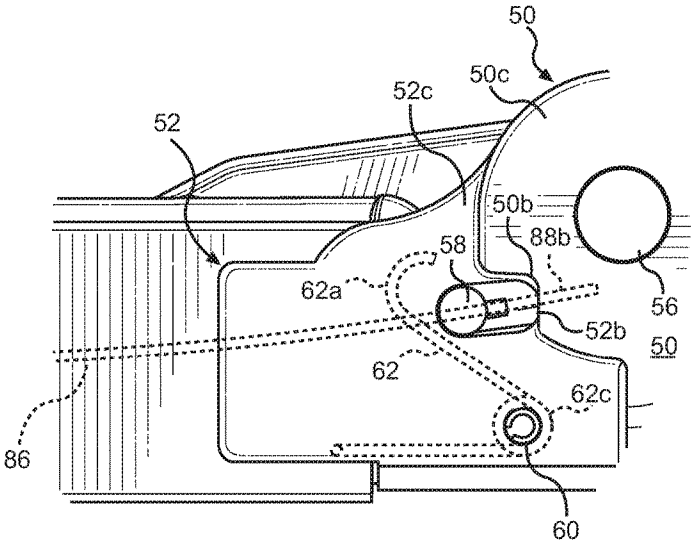
FIG. 7 is an enlarged side view of a second end of the hinge assembly depicted in FIG. 5.

As shown in FIGS. 6 and 7, the cable 86 includes a first end 88A and a second end 88B. The first end 88A is mounted to the crossbar member 80 proximate one of the ends 82. The cable 86 is fixedly mounted to the crossbar member 80, such that rotational movement of the crossbar also causes the first end 88A of the cable to move. As shown in FIG. 2-4, when the support stand 2 is in an extended position, the end 88A of the cable 86 is disposed along a rightward-facing surface of the crossbar 80, the pawl pin 58 is in the first position engaging the notch 50*b*, and rotation of the hinge members 50 and 52 with respect to one another is prevented. On the other hand, as shown in FIGS. 5-7, when the support stand 2 is in a stowed position, the end 88A of the cable 86 is disposed along a downward-facing surface of the crossbar 80, the pawl pin 58 is in the second position not engaging the notch 50*b*, and rotation of the hinge members 50 and 52 with respect to one another is permitted. Accordingly, the pawl pin 58 may be disengaged automatically by simply rotating one of the support stands 2 from an extended position to a stowed position and engaged by rotating the support stand from the stowed position to the extended position.

In a second aspect, the following disclosure relates to a center-folding article of furniture having a locking center hinge and collapsible legs or support members. For instance, the article of furniture may be a folding table or bench. In the case of a bench, the center-folding bench may be placed in an extended or use position and also in a stowed position. In the use position, the locking hinge located between two benchtop halves ensures that the bench is not inadvertently collapsed. The present invention allows this locking hinge to be disengaged automatically by simply rotating one of the legs or support stands from the extended position to the stowed position. The locking hinge may be engaged by rotating the support stand from the stowed position to the extended position.

The center-folding article of furniture is described below with respect to a bench; however, it will be understood that the advantages of this aspect of the disclosure are also applicable to a center-folding table, having two table top halves instead of seating surfaces.

Figure 10:
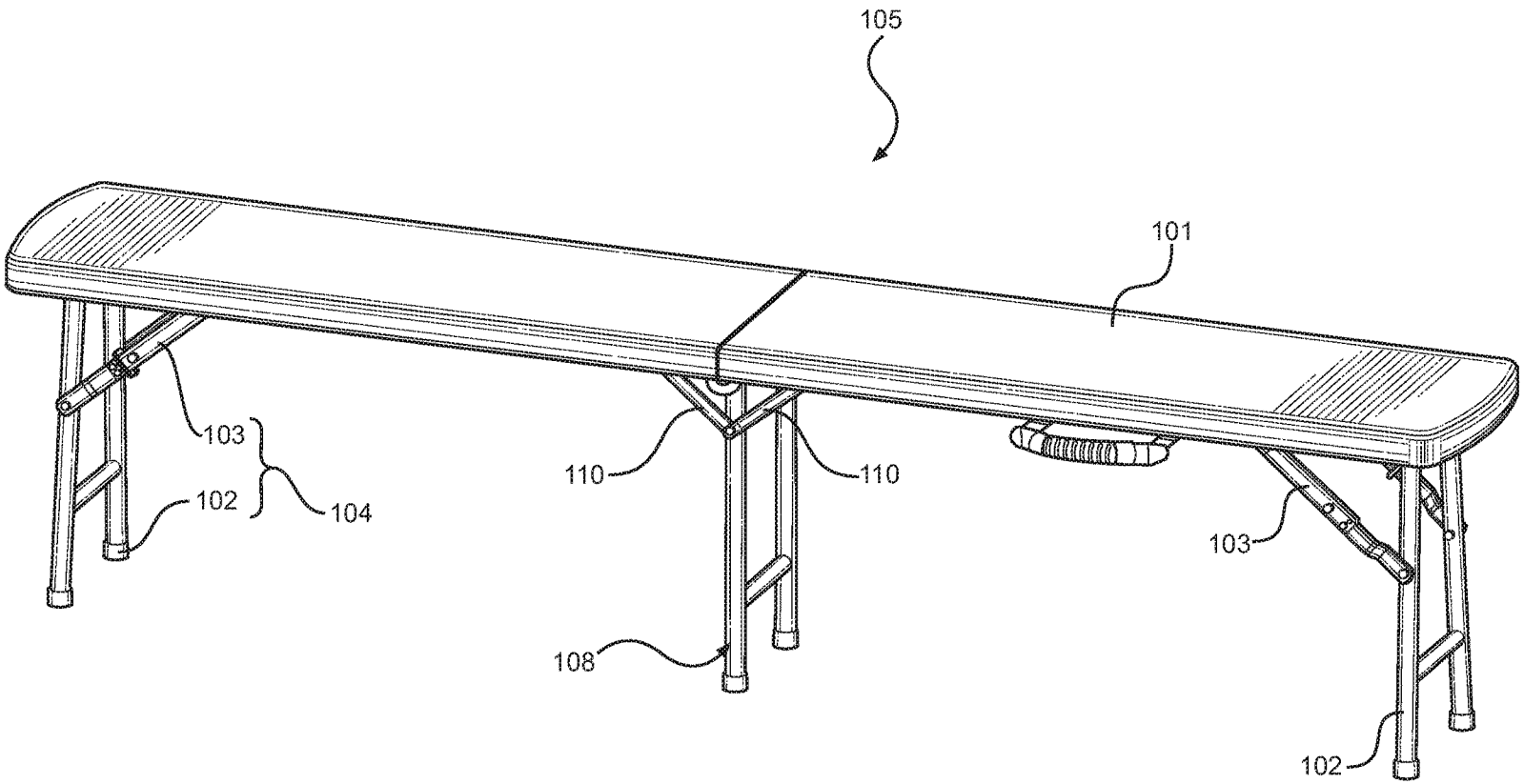
FIG. 10 is a perspective view of a foldable bench with collapsible legs and a hinge assembly according to another embodiment of the present invention.
Figure 11:
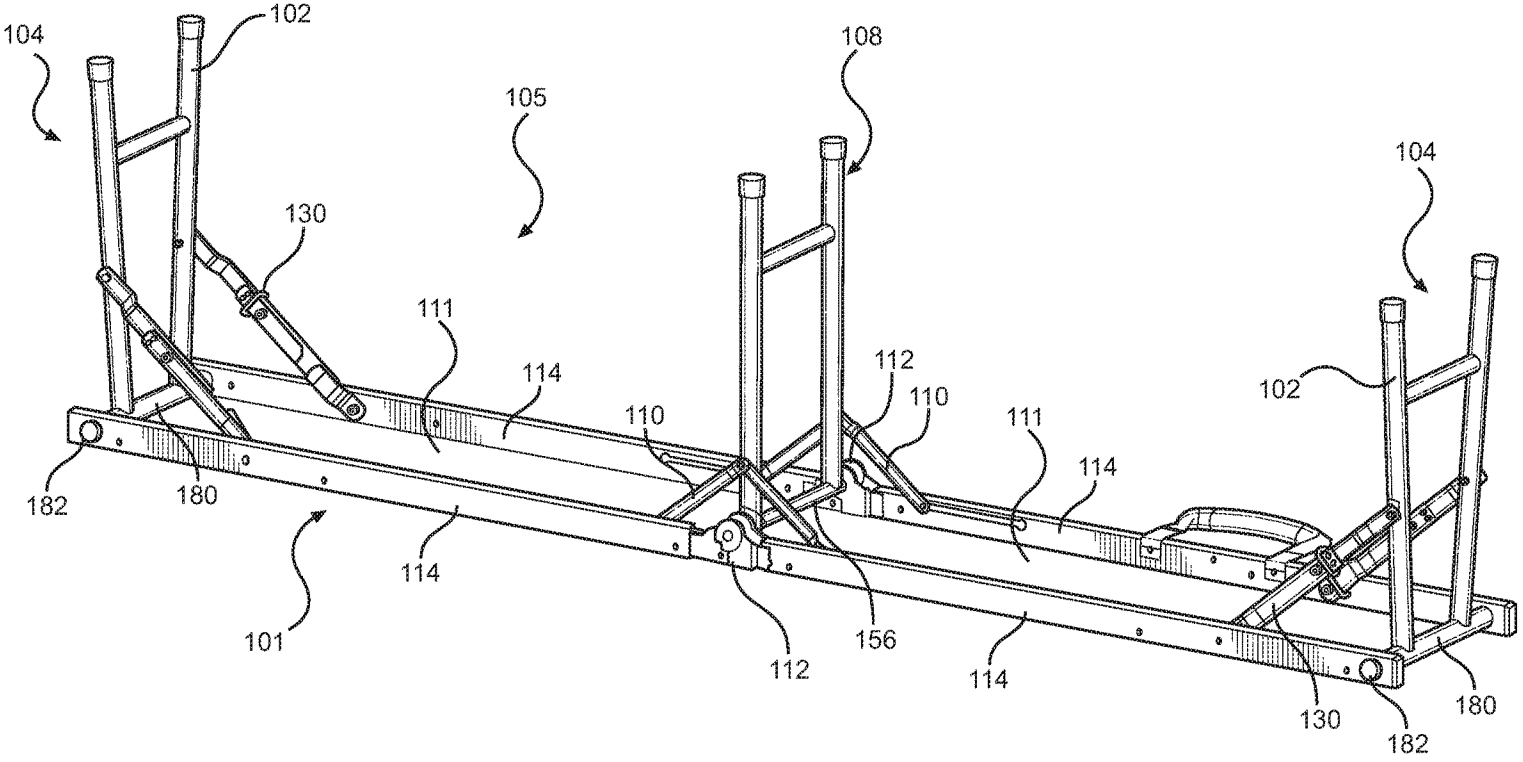
FIG. 11 is a perspective view of a bottom surface of the bench depicted in FIG. 10 with support units shown in an extended position.

Referring to the drawings, there is provided in FIGS. 10 and 11 a center-folding bench 105 in accordance with one embodiment of the present invention. The bench 105 comprises two seating surface halves 101 pivotally connected with each other. Each of the two seating surface halves 101 has a bottom formed with a receiving space 111. The receiving space 111 of each of the seating surface halves 101 has two sides each provided with a frame member 114 secured on each of the two seating surface halves 101 by a plurality of screws.

Figure 14:
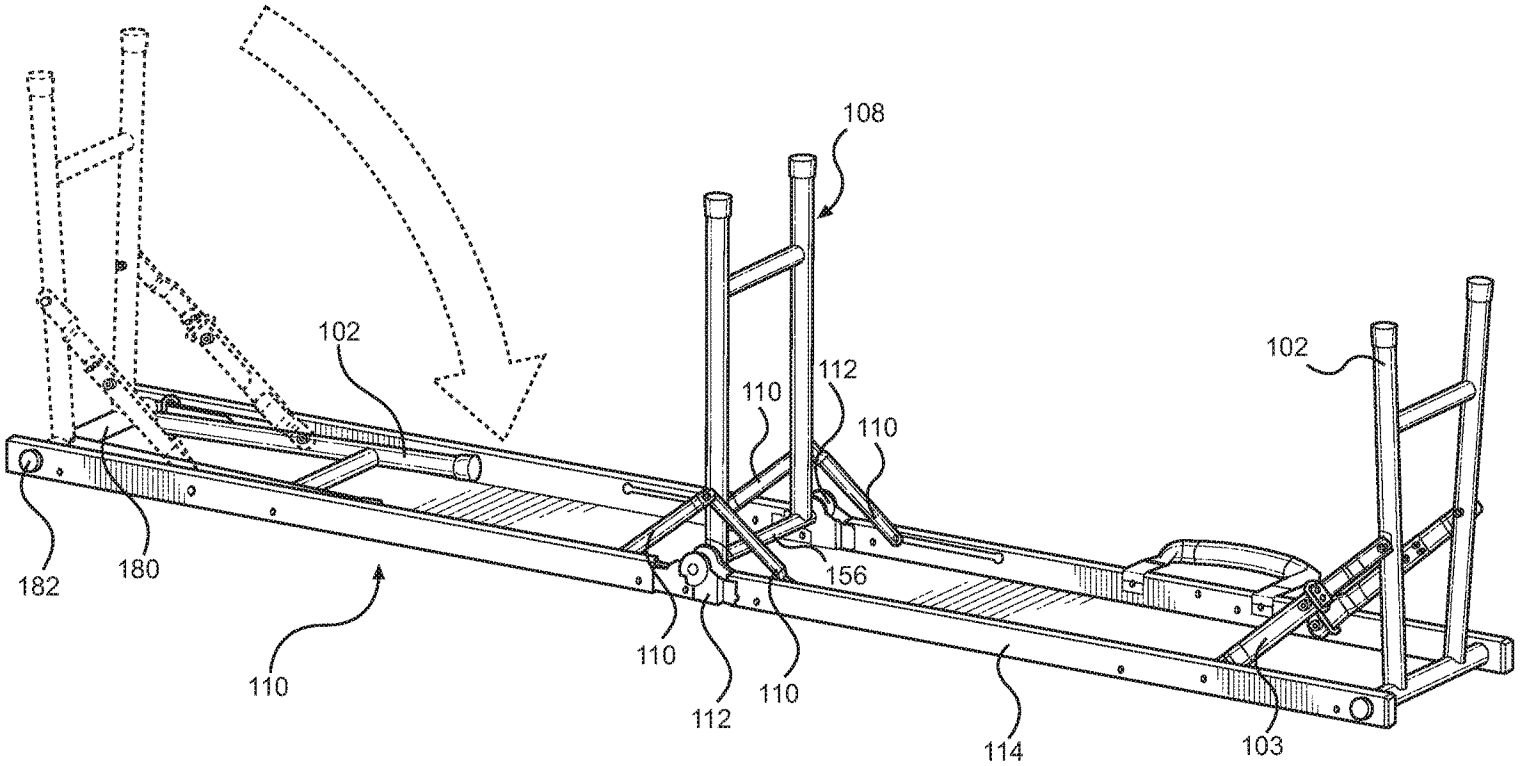
FIG. 14 is a perspective view of the foldable depicted in FIG. 10 with one support unit shown in a stowed position.

The bench 105 also includes two support units (leg assemblies) 104, which are each foldably mounted on a respective one of the two seating surface halves 101. Each of the support units 104 includes a leg or support stand 102 that is mounted in the receiving space 111 of a respective one of the seating surface halves 101. As shown in FIGS. 11 and 14, each support stand 102 has a crossbar member 180 that spans the width of the bench 105 and has opposing ends 182 that extend through openings 184 in the frame members 114. The openings 184 are sized and configured to permit the crossbar 180 to rotate within the opening.

Each support unit 104 also includes at least one support member 103, and preferably two support members 103. Each support member 103 includes a folding leg brace 130, having first and second ends. The first end of the folding leg brace 130 is pivotally mounted to a portion of the support stand 102. The second end of the folding leg brace 130 is pivotally mounted to a portion of one of the frame members 114 secured to the seating surface halves 101. The support units 104 are configured to rotate from an extended position, shown in FIG. 11, to a stowed position, shown in FIG. 14.

Figure 17:
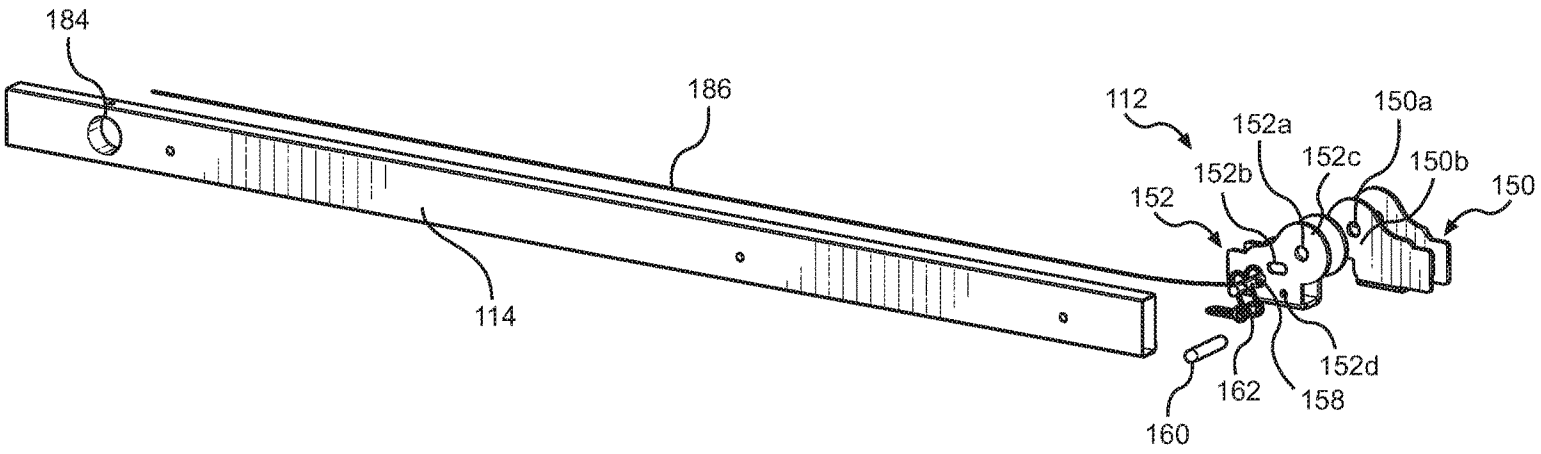
FIG. 17 is an exploded view depicting the hinge assembly shown in FIG. 11.
Figure 18:
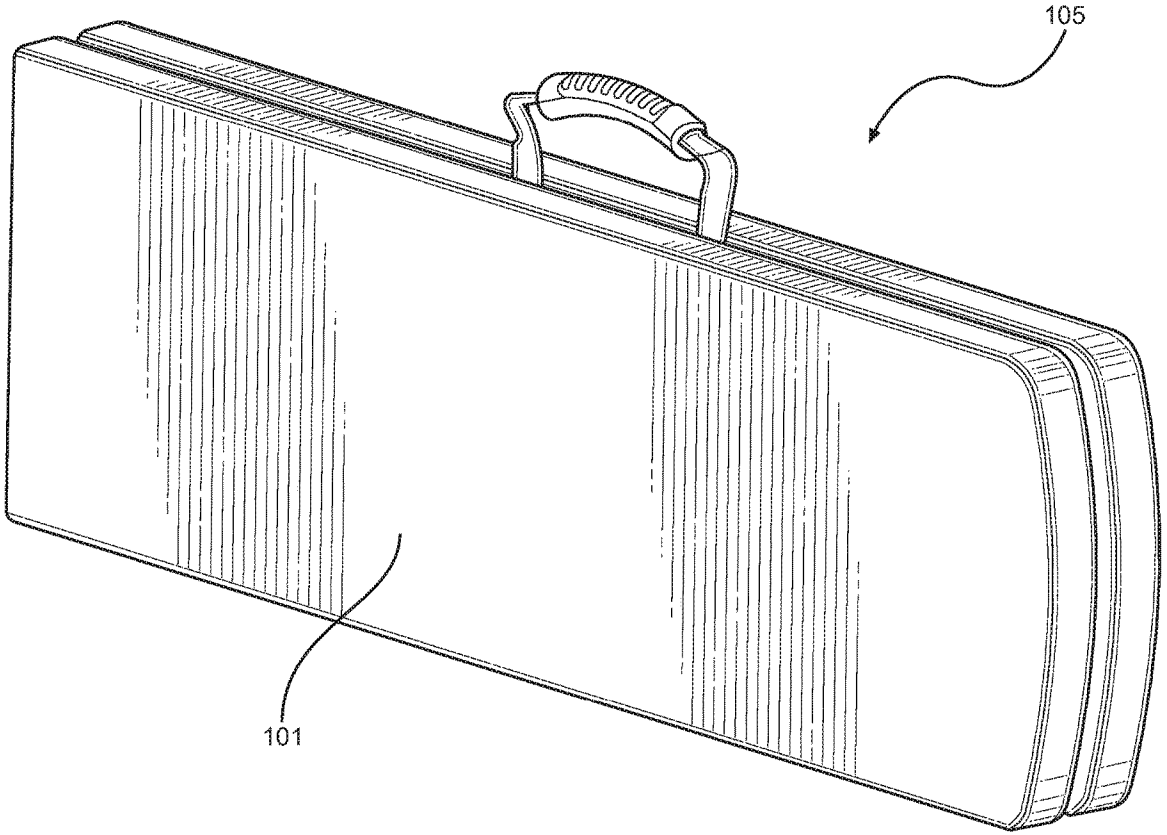
FIG. 18 is a perspective view of the foldable bench depicted in FIG. 10 in a closed position.

The two seating surface halves 101 are pivotally connected with each other by two pivot members 112, which are also referred to herein as hinge assemblies 112, and are configured to rotate from an extended position, shown in FIG. 10, to a stowed position, shown in FIG. 18. As shown in FIGS. 11, 14 and 17, each of the hinge assemblies 112 includes two hinge members 150 and 152 pivotally connected together by a hinge pin 156 which passes through apertures 150*a* and 152*a* in circular tabs 150*c* and 152*c* of the hinge members 150 and 152. In some instances, a single pin 156 spans the width of the bench, along the intersection of the two seating surface halves 101, and an end of the pin connects together each of the hinge assemblies 112.

Figure 19:
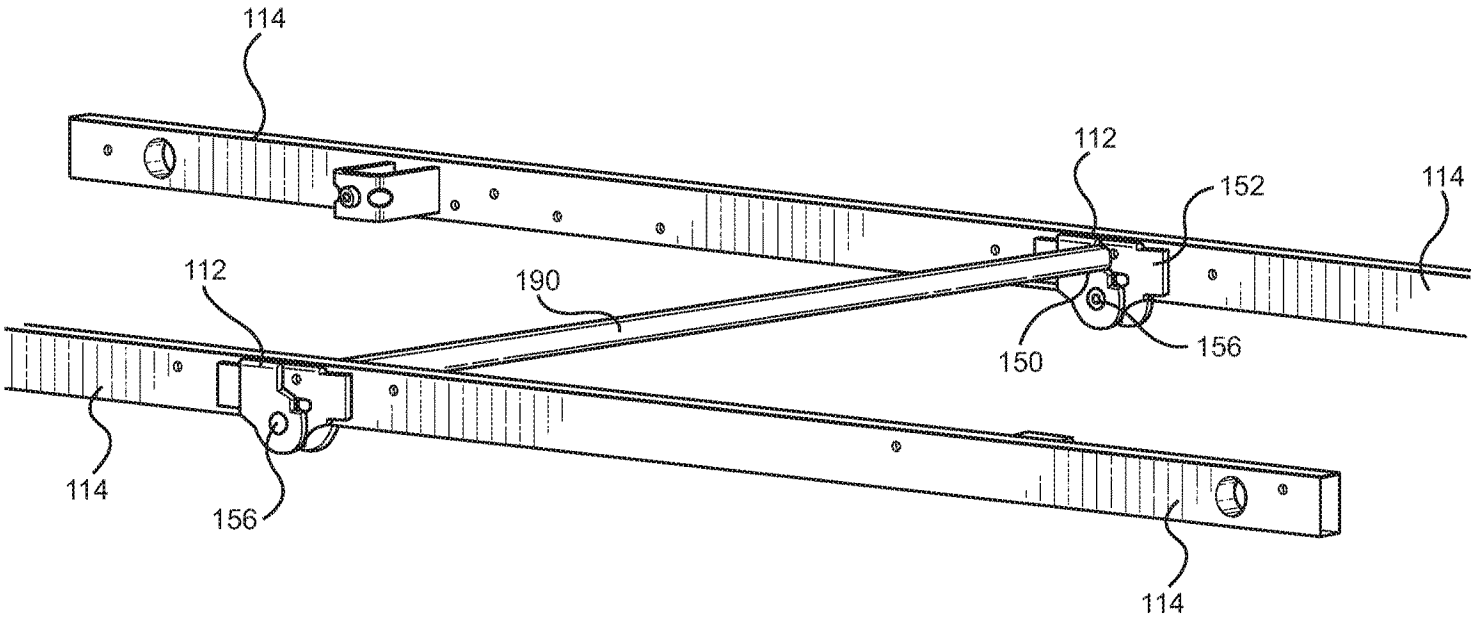
FIG. 19 is a perspective view is of a hinge assembly according to an alternative embodiment of the present invention.

In other embodiments, however, each of the hinge assemblies 112 may have a separate, shorter hinge pin 156, as shown in FIG. 19. In these embodiments, the foldable article of furniture may also include a center rod 190. This center rod 190 is connected to the first and the second hinge assemblies 112 and extends across the width of the support surface (table top or seating surface) halves. In some embodiments, the center rod 190 is connected to the first hinge member 150. Rather than being coaxial with the hinge pins, the center rod 190 is preferably substantially parallel to the two hinge pins 156. More specifically, in certain embodiments, the center rod 190 preferably extends across the width of the table top halves in a location above the first and second hinge pins 156.

The center rod 190 may have a cross-sectional shape which is oval, round, or square. More preferably, the cross-sectional shape is oval. Further, the center rod 190 may have a cross-sectional area which is larger than the cross-sectional area of the hinge pins 156. This provides improved strength and rigidity for the table or bench, as compared to the use of single hinge pin or rod extending the entire width of the table or bench and connecting both hinge assemblies.

In some embodiments, the bench 105 also preferably includes a third leg assembly or support stand 108 which is centrally located about the intersection of the two seating surface halves 101. This third leg assembly 108 is attached to the hinge pin or rod 156 which extends across the width of the bench. The third leg assembly 108 may also be connected to both of the seating surface halves 101 by a plurality of folding leg braces 110. These support members 110 are pivotally connected to the third leg assembly 108 and are preferably both pivotally and slidingly connected to the respective seating surface halves 101. In other embodiments, however, the third leg assembly may be omitted from the center-folding bench or table.

On either side of the hinge member 152 are slots 152*b* through which passes a pawl pin 158. The pawl pin 158 also passes through slots 152*b* on either side of the hinge member 152. The pawl pin 158 is operable to slide laterally in the slots 152*b* between a first position and a second position. As shown best in FIG. 13, in the first position, the pawl pin 158 engages notches 150*b* in the tabs 150*c* of the hinge member 150, thereby preventing rotation of the hinge member 150 with respect to the hinge member 152. In the second position, shown in FIG. 16, the pawl pin 158 disengages the notches 150*b*, thereby allowing rotation of the hinge member 150 with respect to the hinge member 152.

A spring 162 is connected to the hinge member 152 by way of a spring pin 160. The spring pin 160 passes through apertures 152*d* in the hinge member 152 (FIG. 17) and through a coil 162*c* formed in the spring 162. The spring 162 has spring arms 162*a* extending from the coil 162*c* that engage the pawl pin 158. Due to tension in the coil 62*c*, the spring arms 162*a* constantly press against the pawl pin 158, thereby urging the pawl pin 158 toward the first position in the slots 152*b*.

The bench 105 also includes a cable 186, which is disposed along the length of one of the seating surface halves 101 parallel with the respective support tube 114 and connects the pawl pin 158 to the crossbar 180. The cable 186 enables the pawl pin to be moved from the first position to the second position automatically (and vice versa) when the support stand 102 is rotated.

Figure 12:
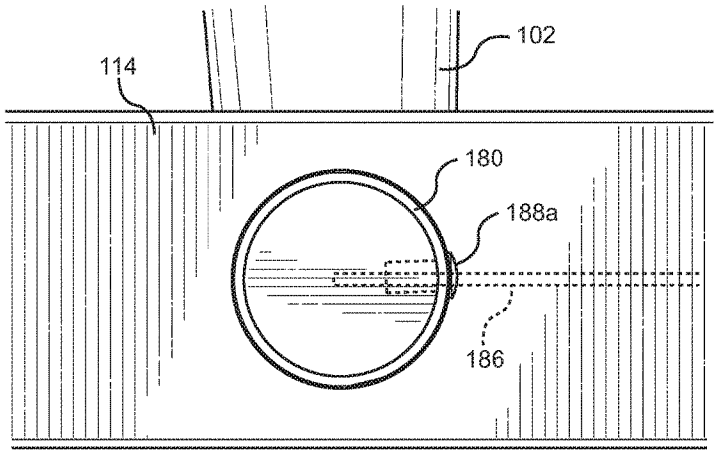
FIG. 12 is an enlarged side view of a first end of the hinge assembly depicted in FIG. 11.
Figure 13:
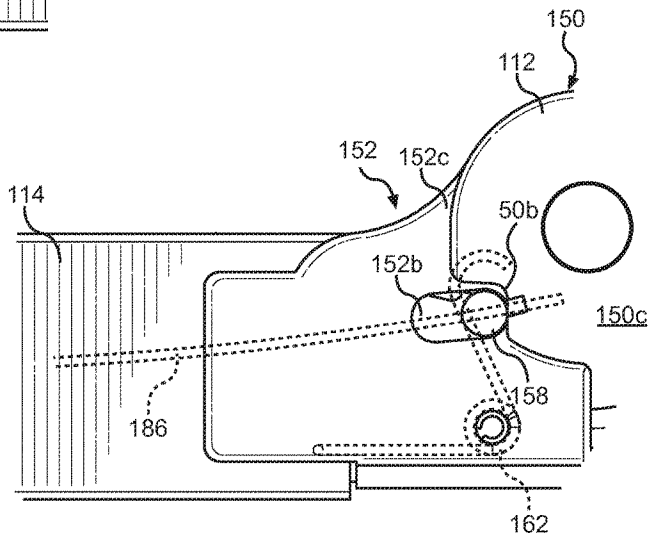
FIG. 13 is an enlarged side view of a second end of the hinge assembly depicted in FIG. 11.
Figure 15:
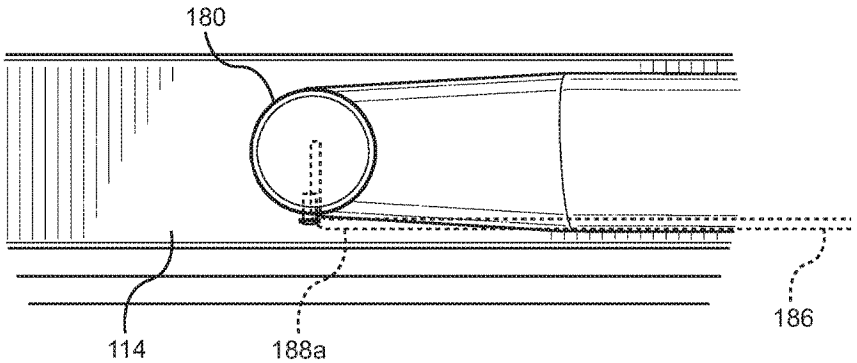
FIG. 15 is an enlarged side view of a first end of the hinge assembly depicted in FIG. 14.
Figure 16:
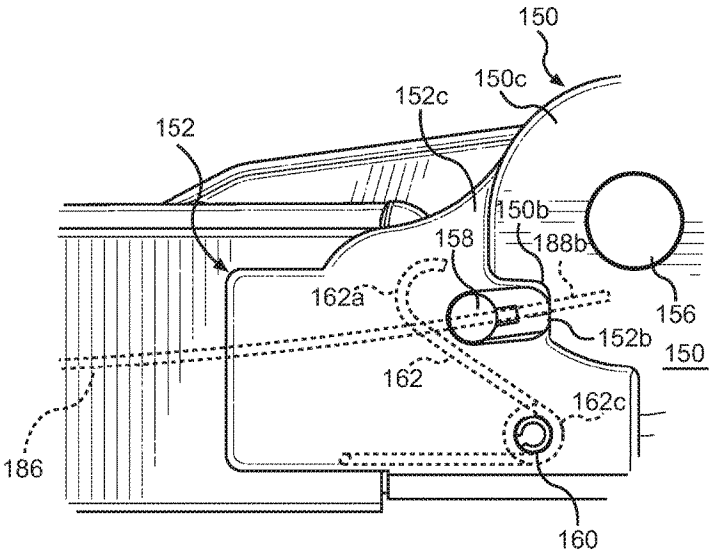
FIG. 16 is an enlarged side view of a second end of the hinge assembly depicted in FIG. 14.

As shown in FIGS. 15 and 16, the cable 186 includes a first end 188A and a second end 188B. The first end 188A is mounted to the crossbar member 180 proximate one of the ends 182. The cable 186 is fixedly mounted to the crossbar member 180, such that rotational movement of the crossbar also causes the first end 188A of the cable to move. As shown in FIG. 11-13, when the support stand 102 is in an extended position, the end 188A of the cable 186 is disposed along a rightward-facing surface of the crossbar 180, the pawl pin 158 is in the first position engaging the notch 150*b*, and rotation of the hinge members 150 and 152 with respect to one another is prevented. On the other hand, as shown in FIGS. 14-16, when the support stand 102 is in a stowed position, the end 188A of the cable 186 is disposed along a downward-facing surface of the crossbar 180, the pawl pin 158 is in the second position not engaging the notch 150*b*, and rotation of the hinge members 150 and 152 with respect to one another is permitted. Accordingly, the pawl pin 154 may be disengaged automatically by simply rotating one of the support stands 102 from an extended position to a stowed position and engaged by rotating the support stand from the stowed position to the extended position.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A foldable article of furniture comprising:

first and second support surface halves, each support surface half having a first side frame member mounted to the support surface half and disposed along a first edge thereof and a second side frame member mounted to the support surface half and disposed along a second edge thereof;

a first furniture leg having a crossbar rotatably mounted between the first and second side frame members of the first support surface half and a second furniture leg having a crossbar rotatably mounted between the first and second side frame members of the second support surface half, wherein each crossbar rotates as the respective furniture leg is pivoted from an extended position to a stowed position;

a first hinge assembly comprising a first hinge member mounted to the first support surface half and a second hinge member mounted to the second support surface half and pivotally connected to the first hinge member by a first hinge pin for pivotally connecting together the support surface halves;

a second hinge assembly comprising a third hinge member mounted to the first support surface half and a fourth hinge member mounted to the second support surface half and pivotally connected to the third hinge member by a second hinge pin for pivotally connecting together the support surface halves; and a center rod which is connected to the first and the second hinge assemblies and which extends across the width of the table top halves substantially parallel to the first and second hinge pins wherein the first hinge member includes a notch for selectively engaging a pawl pin and the second hinge member includes a slot configured to receive a pawl pin, and further comprising a pawl pin disposed in the slot of the second hinge member and operable to slide in the slot between a first position and a second position, wherein the pawl pin engages the notch of the first hinge member when in the first position, thereby preventing rotation of the first hinge member with respect to the second hinge member, wherein the pawl pin disengages the notch of the first hinge member when in the second position, thereby allowing rotation of the first hinge member with respect to the second hinge member; and further comprising a cable having a first end and a second end, wherein the first end of the cable is secured to a portion of the furniture leg and the second end of the cable is secured to the pawl pin, such that moving the furniture leg from an extended position to a stowed position causes movement of the second end of the cable, thereby moving the pawl pin from the first position to the second position to disengage the pawl pin from the notch.

2. The foldable article of furniture of claim 1 further comprising a spring member having spring arms that engage the pawl pin and urge the pawl pin toward the first position.

3. The foldable article of furniture of claim 1, wherein the center rod is connected to the first hinge member.

4. The foldable article of furniture of claim 1, wherein the center rod extends across the width of the table top halves in a location above the first and second hinge pins.

5. The foldable article of furniture of claim 1, wherein the article of furniture comprises a table, and the first and second support surface halves each comprise a table top half.

6. The foldable article of furniture of claim 1, wherein the article of furniture comprises a bench, and the first and second support surface halves each comprise a bench seating surface.

7. A foldable article of furniture comprising:

a furniture support surface comprising a first support surface half and a second support surface half, the first and second support surface halves each having a substantially planar top surface, a bottom surface opposite the top surface, an inner edge, and an opposing outer edge which is substantially parallel to the inner edge;

a foldable leg assembly attached to the bottom surface of each of the support surface halves, wherein each leg assembly is operable to collapse independently of the other leg assembly and is movable between an extended position and a stowed position, and wherein each leg assembly has a crossbar mounted between side frame members, the crossbar rotating as the respective leg assembly is pivoted from the extended position to the stowed position;

a first hinge assembly comprising a first hinge member mounted to the first support surface half and a second hinge member mounted to the second support surface half and pivotally connected to the first hinge member by a first hinge pin for pivotally connecting together the support surface halves;

a second hinge assembly comprising a third hinge member mounted to the first support surface half and a fourth hinge member mounted to the second support surface half and pivotally connected to the third hinge member by a second hinge pin for pivotally connecting together the support surface halves; and a center rod which is connected to the first and the second hinge assemblies and which extends across the width of the table top halves substantially parallel to the first and second hinge pins wherein the first hinge member includes a notch for selectively engaging a pawl pin and the second hinge member includes a slot configured to receive a pawl pin, and further comprising a pawl pin disposed in the slot of the second hinge member and operable to slide in the slot between a first position and a second position, wherein the pawl pin engages the notch of the first hinge member when in the first position, thereby preventing rotation of the first hinge member with respect to the second hinge member, wherein the pawl pin disengages the notch of the first hinge member when in the second position, thereby allowing rotation of the first hinge member with respect to the second hinge member; and further comprising a cable having a first end and a second end, wherein the first end of the cable is secured to a portion of the furniture leg and the second end of the cable is secured to the pawl pin, such that moving the furniture leg from an extended position to a stowed position causes movement of the second end of the cable, thereby moving the pawl pin from the first position to the second position to disengage the pawl pin from the notch.

8. The foldable article of furniture of claim 7 further comprising a spring member having spring arms that engage the pawl pin and urge the pawl pin toward the first position.

9. The assembly of claim 7, wherein the center rod is connected to the first hinge member.

10. The foldable article of furniture of claim 7, wherein the center rod extends across the width of the table top halves in a location above the first and second hinge pins.

11. The foldable article of furniture of claim 7, wherein the article of furniture comprises a table, and the first and second support surface halves each comprise a table top half.

12. The foldable article of furniture of claim 7, wherein the article of furniture comprises a bench, and the first and second support surface halves each comprise a bench seating surface.

* * * * *